US007278364B2

(12) United States Patent
Root, Jr.

(10) Patent No.: US 7,278,364 B2
(45) Date of Patent: Oct. 9, 2007

(54) RECONFIGURABLE ATTACK AND RECONNAISSANCE VESSEL I

(75) Inventor: George Raymond Root, Jr., Gambrills, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/119,187

(22) Filed: Apr. 29, 2005

(65) Prior Publication Data

US 2006/0075949 A1 Apr. 13, 2006

Related U.S. Application Data

(60) Provisional application No. 60/567,271, filed on Apr. 30, 2004.

(51) Int. Cl.
*B63B 1/00* (2006.01)

(52) U.S. Cl. ..... 114/61.15

(58) Field of Classification Search .... 114/61.1–61.17, 114/61.18, 265, 61.19, 123, 312, 66, 39.23; D12/304; 440/6
See application file for complete search history.

(56) References Cited

U.S. PATENT DOCUMENTS

| | | | | |
|---|---|---|---|---|
| 1,334,445 A | | 3/1920 | Gaffney | |
| 1,920,507 A | | 8/1933 | Holloway | |
| 2,227,725 A | | 1/1941 | Laddon | |
| 2,347,959 A | * | 5/1944 | Moore et al. | 114/283 |
| 3,430,595 A | * | 3/1969 | Tulleners | 114/61.16 |
| 3,541,987 A | * | 11/1970 | Barkley | 114/61.16 |
| 4,008,680 A | * | 2/1977 | Alexander, Jr. | 440/6 |
| 4,085,695 A | | 4/1978 | Bylo | |
| 4,474,128 A | * | 10/1984 | Wallach | 114/123 |
| 5,176,098 A | | 1/1993 | Royle | |
| 5,237,947 A | * | 8/1993 | Manning | 114/61.16 |
| 5,544,607 A | | 8/1996 | Rorabaugh et al. | |
| 6,089,173 A | * | 7/2000 | Lande | 114/39.23 |

FOREIGN PATENT DOCUMENTS

| | | |
|---|---|---|
| DE | 3326942 A1 | 2/1984 |
| DE | 3326945 A1 | 2/1984 |
| DE | 3614291 A1 | 10/1987 |
| WO | 03/033336 A1 | 4/2003 |

* cited by examiner

*Primary Examiner*—Ed Swinehart
(74) *Attorney, Agent, or Firm*—DeMont & Breyer LLC

(57) ABSTRACT

A reconfigurable marine vessel is disclosed. The marine vessel includes an upper hull, two propulsion hulls, and two struts for coupling the propulsion hulls to the upper hull. The struts are segmented and are capable of reconfiguring the marine vessel. In one configuration, the vessel can be folded for launch and recovery. In a second configuration, the struts can be extended downwardly for cruising and surveillance. In a third configuration, the struts can be extended laterally from the upper hull to provide a minimum-draft configuration for approaching a beach.

6 Claims, 10 Drawing Sheets

RECONFIGURABLE ATTACK AND RECONNAISSANCE VESSEL I

STATEMENT OF RELATED CASES

This case claims priority of U.S. provisional patent application 60/567,271, which was filed on Apr. 30, 2004 and is incorporated by reference herein.

FIELD OF THE INVENTION

The present invention relates generally to high-speed attack and reconnaissance vessels.

BACKGROUND OF THE INVENTION

When maneuvering in restricted conditions, moored, or at anchor, Navy vessels are particularly vulnerable to attack from a group of small, fast boats. Due to their size, speed, and maneuverability, these small boats can attack and then run and hide from larger navy vessels. To make matters worse, hostiles will often be operating in their own waters where they will typically enjoy a significant numerical advantage and superior knowledge of the waterways. This type of attack, which is referred to as a "small-boat-swarm," is the tactic of choice for terrorists.

Small-boat-swarm is best countered by similarly-sized, stealthy, fast, heavily-armed craft. An appropriately outfitted Zodiac-type raft has been used for this service. But even highly-trained navy personnel have a limited capability to withstand the repeated shock to their bodies that occurs when traveling in such craft at high speed in moderately high sea states.

Another type of craft that could be used for this type of engagement is an attack helicopter. The primary attributes of the attack helicopter include its tactical agility (e.g., speed, horizon masking, and engagement geometry), assortment of weaponry, and its ability to engage multiple targets. Its primary limitations are (1) a relatively limited sortie time (e.g., about 2 hours) and (2) that it is not particularly stealthy; that is, it has substantial radar, infrared, visual and audible signatures.

There is a need, therefore, for a vessel that is fast, maneuverable, and suitably equipped to engage and counter a small-boat-swarm or reconnoiter undetected in littoral waters.

SUMMARY

The present invention provides a relatively small, stable, low-signature, fast, heavily-armed marine vessel that can sortie from a larger ship and conduct surface warfare functions in shallow littoral environments.

One of the key features of a marine vessel in accordance with the illustrative embodiment of the present invention is that it is reconfigurable into any of a variety of different configurations. At least one of the configurations possesses the characteristics of, and can be operated as, a SWATH craft. To provide background for the description of the illustrative embodiment, attributes of a conventional SWATH craft are described below.

"SWATH" is an acronym for "small waterplane area twin hull." A SWATH craft consists of one or two lower hulls or pontoons that are connected to an upper hull by fixed struts. The lower hulls are completely submerged such that they ride below the surface of the water. A SWATH craft does not rely on dynamic lift (i.e., the hydrofoil principle) to support the vessel or augment buoyancy; all lift is provided by the buoyancy of the craft.

The struts, which lift the upper hull completely above the water, have a small waterplane area (i.e., the cross sectional area at the waterline). This results in longer natural periods and reduced buoyancy-force changes. The submerged hulls of a SWATH craft do not follow surface wave motion. Control planes, which depend from the submerged hulls, provide additional motion damping and dynamic stabilization when underway. The net result of the SWATH configuration and mode of operation is extraordinary stability. That is, a SWATH craft is typically much more stable in high sea-state conditions than conventional hulls of the same length.

The stability advantage of a SWATH craft is lost, however, if the upper hull comes into contact with waves. As a consequence, the greater the distance between the lower and upper hulls, the higher the sea state in which the SWATH craft can maintain stable operation. Of course, as the distance between the lower and upper hulls increases, so does the difficulty of launching, recovering, and handling a SWATH craft aboard a mother ship. Thus, SWATH craft that are small enough to operate from a mother ship do not remain stable in relatively higher sea states, while those that are large enough to be stable in significant sea states are too large to be routinely taken aboard other vessels.

This size-related difficulty is one of a number of the issues that are addressed by the reconfigurable marine vessel disclosed herein. In fact, due to its ability to reconfigure, the subject marine vessel possesses an extraordinarily useful but otherwise highly improbable combination of attributes, as described further below.

The ability of the marine vessel disclosed herein to reconfigure is provided by "articulating" the struts that couple the lower hulls to the upper hull. The struts are segmented and are operatively coupled to a mechanism that enables the segments to move relative to one another and relative to the upper hull.

Within the range of movement of the struts, the vessel is infinitely reconfigurable. The marine vessel will, however, typically adopt one of three primary configurations, as described below:

- A launch/recovery configuration, wherein the struts are folded. This enables the vessel to "fold" in upon itself so that it is small enough to be launched, recovered and housed aboard a mother ship. When folded, the vessel is about ⅔ the height, ⅔ the width, and occupies less than ½ the storage volume as when the struts are fully extended.
- A cruise and surveillance configuration, wherein the struts are fully extended downward and slightly outward from the upper hull. In this configuration, the distance between the lower hulls and the upper hull is at a maximum and is sufficient to enable operation in significant sea states. The marine vessel can be operated as a SWATH in this configuration.
- A minimum draft configuration, wherein the struts are laterally extended relative to the upper hull so that the lower hulls and the upper hull are substantially coplanar and all are partially submerged. In this configuration, the vessel requires minimum draft (about 0.9 meters), and is essentially able approach a beach, etc.

It is notable that in some of its primary configurations, the marine vessel is not, per se, consistent with the definition of "SWATH" that was provided above. Moreover, even when configured in what is nominally a SWATH form, the marine vessel can be operated in a manner that is not consistent with a SWATH craft (e.g., partially submerging the upper hull, etc). In other words, a marine vessel in accordance with the illustrative embodiment is capable of physically reconfiguring or changing its mode of operation to be consistent with, or inconsistent with, a SWATH craft, as suits the mission.

The marine vessel disclosed herein is advantageously equipped with close-in offensive weapons that are capable of destroying or otherwise neutralizing most small vessels. Furthermore, the vessel is advantageously hardened to survive multiple hits from the small arms or other weapons that are likely to be fired at it.

Its articulating struts, weapons complement, hardened structure, and other features described herein endow a marine vessel in accordance with the illustrative embodiment with one or more of the following attributes, among others:

- High-Speed capabilities, so that littoral areas can be patrolled and controlled very rapidly, and to provide a rapid threat response.
- Stability in Elevated Sea States so that both weapons and sensors can be used to their full capability and so that crew members are tactically viable for extended periods.
- An Ability to Reconfigure to a configuration that is mission-appropriate, including an ability to "fold" itself, thereby reducing the volume required for storage and transport.
- An Ability to partially submerge to enable its visual, IR and radar signatures to be reduced so that it can hide, loiter, observe, and attack with the element of surprise.
- Offensive capabilities, essentially those of an attack-helicopter, to assure superior lethality against a wide range of hostile littoral vessels.

The foregoing attributes enable the marine vessel disclosed herein to support a variety of covert naval operations and enjoy a significant tactical advantage when conducting such operations. Likely operations will include, for example, over-the-horizon control of UAVs, monitoring and patrolling potential threat sanctuaries, reconnoitering narrow passages for high-value units, interception and engagement of hostile surface craft, and clandestine small-force insertion.

DETAILED DESCRIPTION

The illustrative embodiment of the present invention is reconfigurable marine vessel 100. This marine vessel, and various alternative embodiments of it, incorporate a number of important features in addition to the ability to reconfigure. This disclosure, however, focuses primarily on the ability of marine vessel 100 to reconfigure. Other features, attributes, and capabilities of marine vessel 100 are disclosed in U.S. patent application Ser. No. 11/118,262 entitled "Reconfigurable Attack and Reconnaissance Vessel II," which is incorporated by reference herein.

Marine vessel 100 is particularly well suited for military applications, but its the basic hull form and ability to reconfigure can be adapted for non-military applications.

In the illustrative embodiment, marine vessel 100 is manned. There are, however, alternative embodiments in which a marine vessel in accordance with the present invention is unmanned. The unmanned vessel, which is not depicted herein, has substantially the same form as the manned vessel. The unmanned vessel can, of course, be smaller than the manned version, and in some embodiments is about one half of the length and one half of the width (in the cruise-and-surveillance configuration) of manned marine vessel 100. The unmanned vessel is typically operated by a remote, airborne operator (in a helicopter, etc.).

Introduction to the Three Primary Configurations of Marine Vessel 100

Figure 1B:
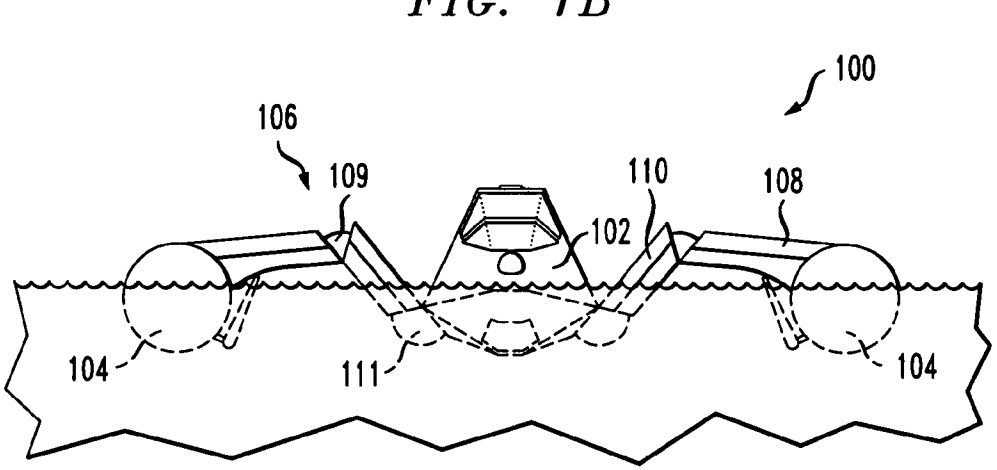
FIGS. 1A through 1C depict reconfigurable marine vessel 100 in accordance with the illustrative embodiment of the present invention. These Figures depict a bow-end view of marine vessel 100 in one of its three primary configurations: cruise-and-surveillance (FIG. 1A); minimum-draft (FIG. 1B); and launch-and-recovery (FIG. 1C).
Figure 1A:
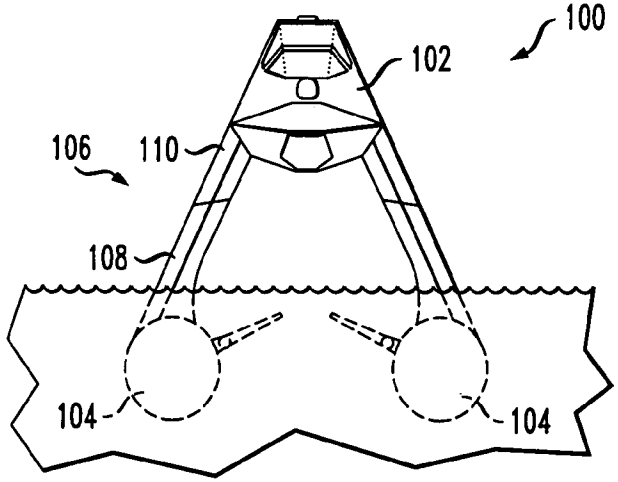
Figure 1C:
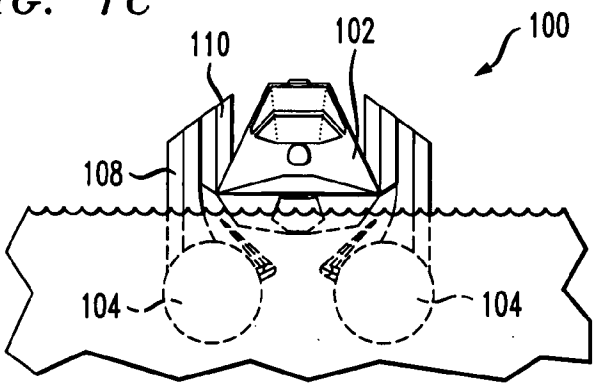

Referring now to the Drawings, FIGS. 1A through 1C depict, via bow-end views, three primary configurations of marine vessel 100. As depicted in these Figures, marine vessel 100 includes upper hull 102, lower hulls 104, and struts 106.

The struts are segmented into lower segment 108 and upper segment 110 by joints or hinges. Hinge 109 movably couples lower segment 108 to upper segment 110 and hinge 111 movably couples upper segment 110 to upper hull 102. The three primary configurations of marine vessel 100 are obtained by changing the position of the segments with respect to one another, with respect to upper hull 102, or both. It is to be understood that, within their range of motion, the segments of strut 106 are substantially infinitely positionable so that are variety of other configurations are possible as well. Further description of struts 106 and the other basic structural elements of marine vessel 100 is provided later in this Specification.

FIGS. 1A, 2, 3, 4A, 4B, and 6A-6C depict vessel 100 in a cruise-and-surveillance configuration. In this configuration, lower strut 108 and upper strut 110 are co-linear and are fully extended below and slightly outward of upper hull 102. In this configuration, marine vessel 100 has its maximum height, which for the illustrative embodiment is about 5.6 meters (see FIG. 4A: $H_F$+D).

Figure 6A:
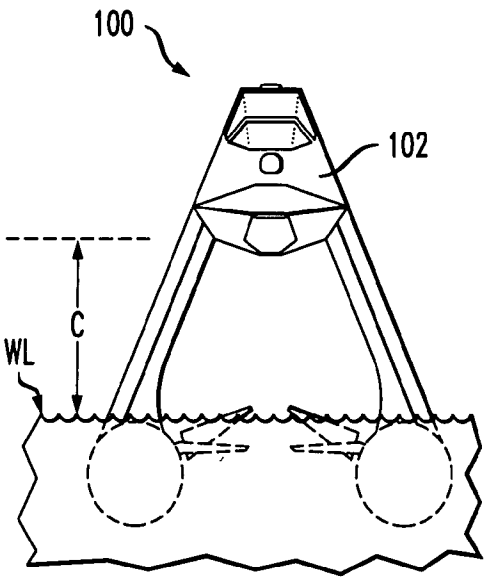
FIG. 6A depicts a bow-end view of marine vessel 100 in the cruise-and-surveillance configuration, and in a slow-speed mode.
Figure 6B:
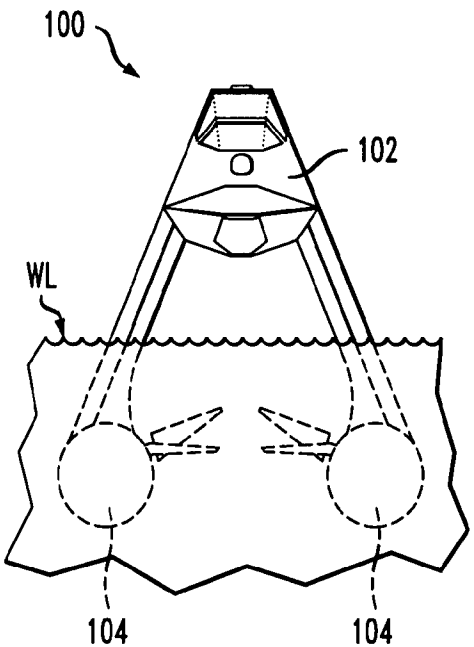
FIG. 6B depicts a bow-end view of marine vessel 100 in the cruise-and-surveillance configuration, and in a high-speed, SWATH mode.
Figure 6C:
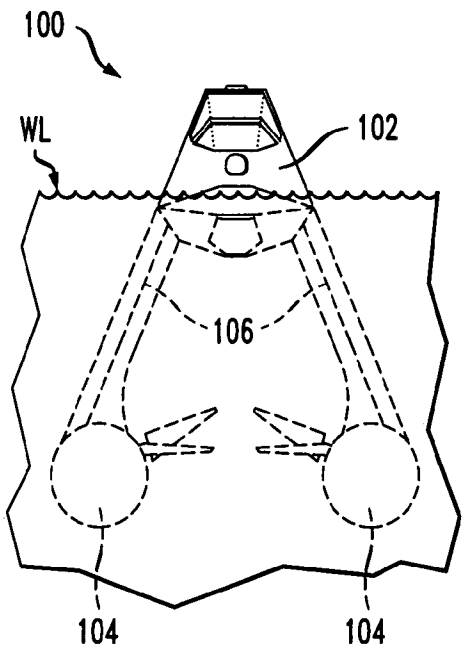
FIG. 6C depicts a bow-end view of marine vessel 100 in the cruise-and-surveillance configuration, and in a loitering mode.

In various operating modes of this configuration, which are described later in this Specification, lower hulls 104 can be completely submerged, as depicted in FIGS. 1A, 6B and 6C, or can partially breach the surface. In fact, in some operating modes of this configuration, as much as about 40 percent of the volume of upper hull 102 can be below the waterline. The operation of marine vessel 100 in the cruise-and-surveillance configuration is described in further detail later in this Specification.

Figure 7:
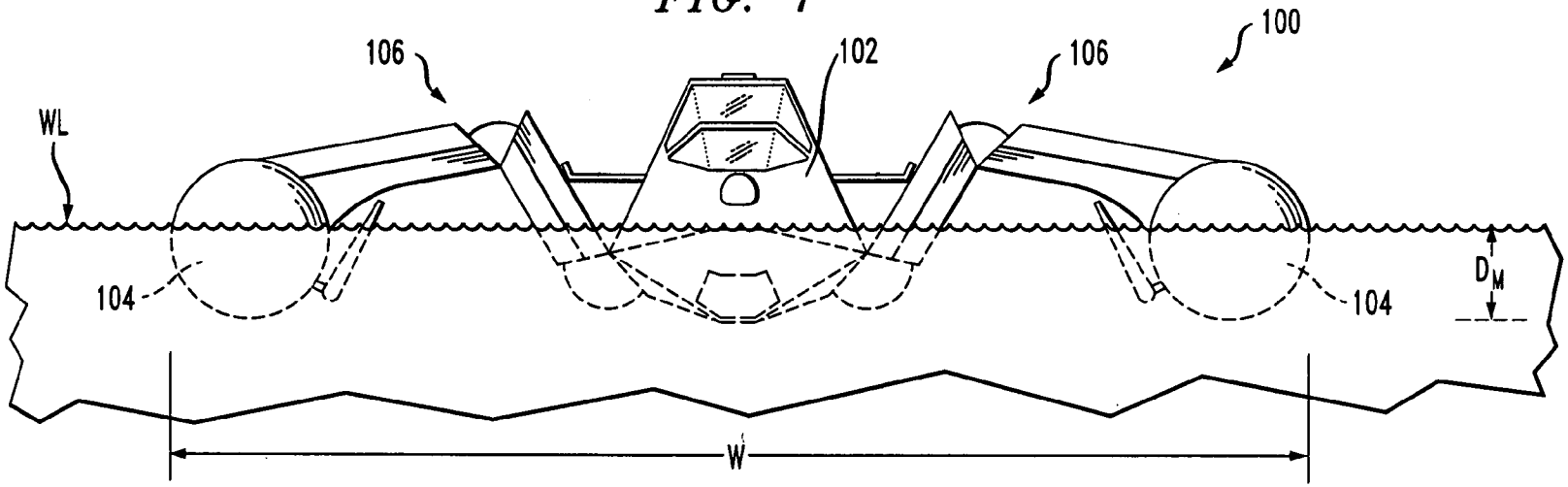
FIG. 7 depicts a bow-end view of marine vessel 100 in the minimum-draft configuration.
Figure 8:
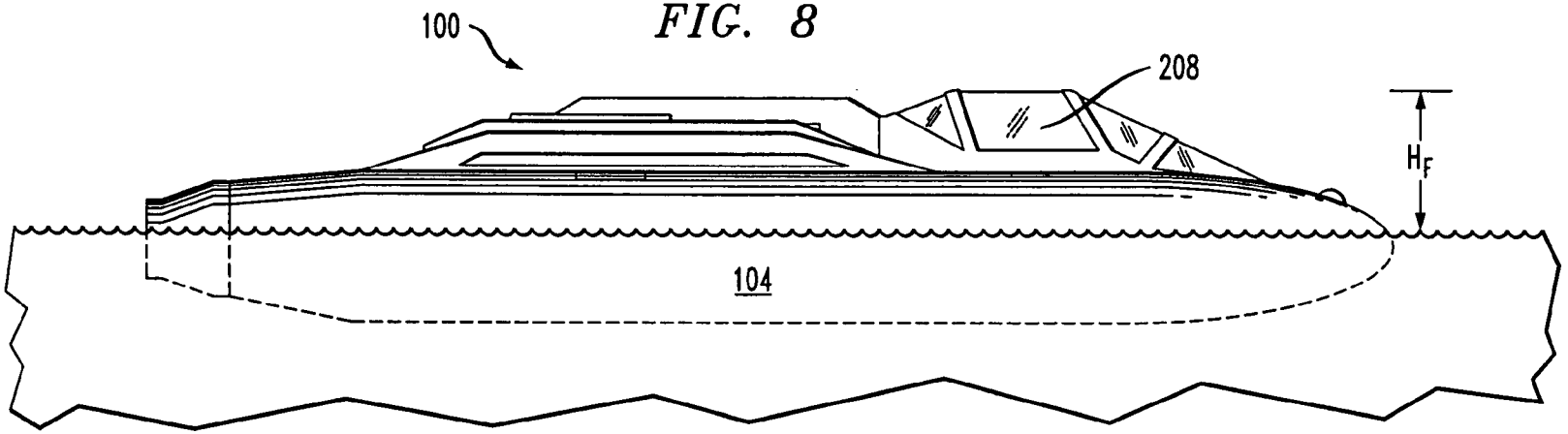
FIG. 8 depicts a side view of marine vessel 100 in the minimum-draft configuration.

FIGS. 1B, 7 and 8 depict marine vessel 100 in a minimum-draft configuration. In this configuration, lower strut 108 and upper strut 110 extend substantially laterally from upper hull 102. In the nominal minimum-draft configuration, the bottom surface of lower hulls 104 and bottom surface of upper hull 102 are substantially co-planar. In this configuration, marine vessel 100 exhibits its minimum draft, which for the illustrative embodiment is about 0.9 meters (see FIG. 7, $D_M$). Also, in this configuration, marine vessel 100 has its maximum width W, which for the illustrative embodiment, is about 9.5 meters (see FIG. 7).

As depicted in FIGS. 1B, 7 and 8, in the minimum-draft configuration, a substantial portion of lower hulls 104 are above the water line and a substantial portion of upper hull 102 is below the water line. The operation of marine vessel 100 in this configuration is described further later in this Specification.

Figure 9:
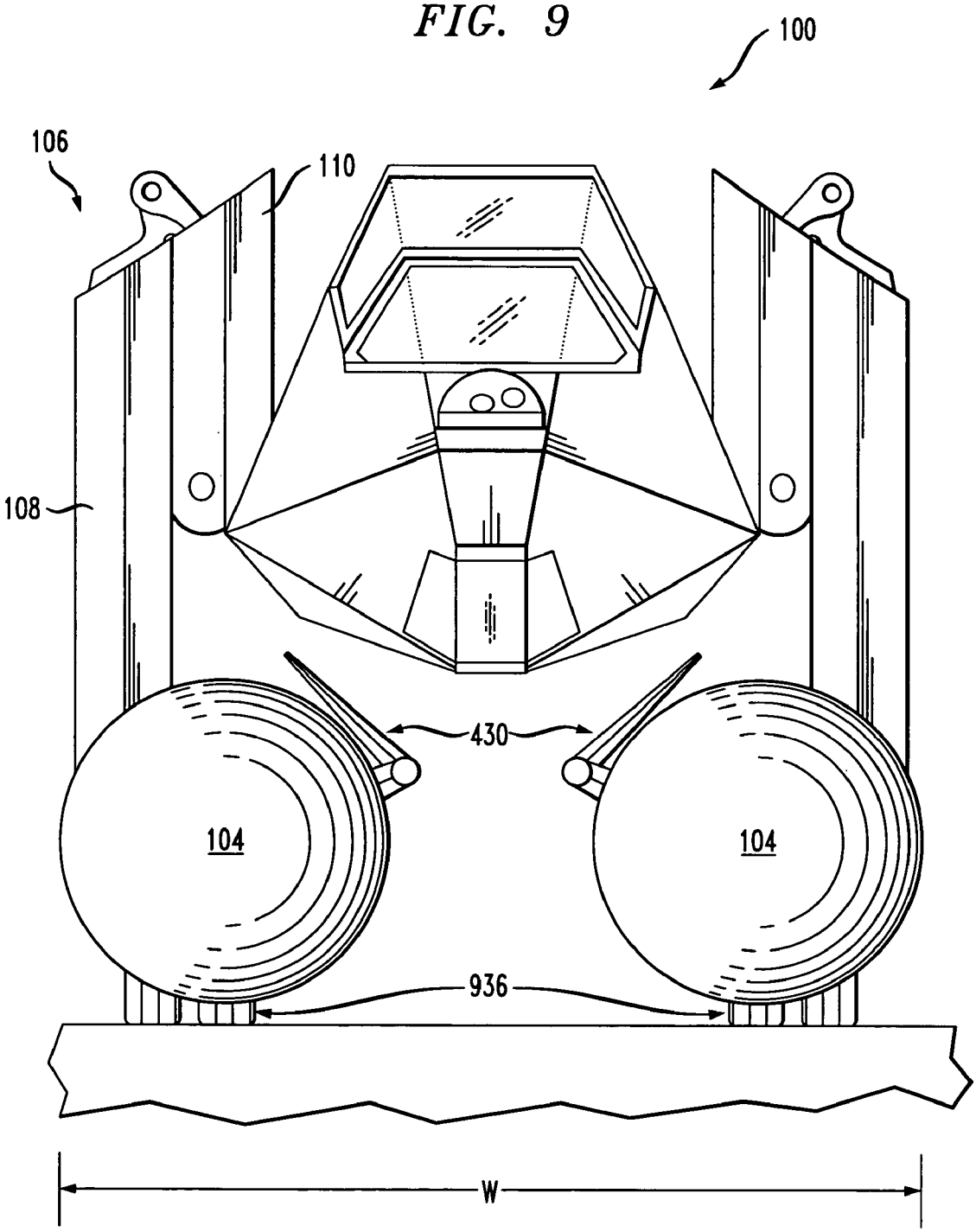
FIG. 9 depicts a bow-end view of marine vessel 100 in the launch-and-recovery configuration.
Figure 10:
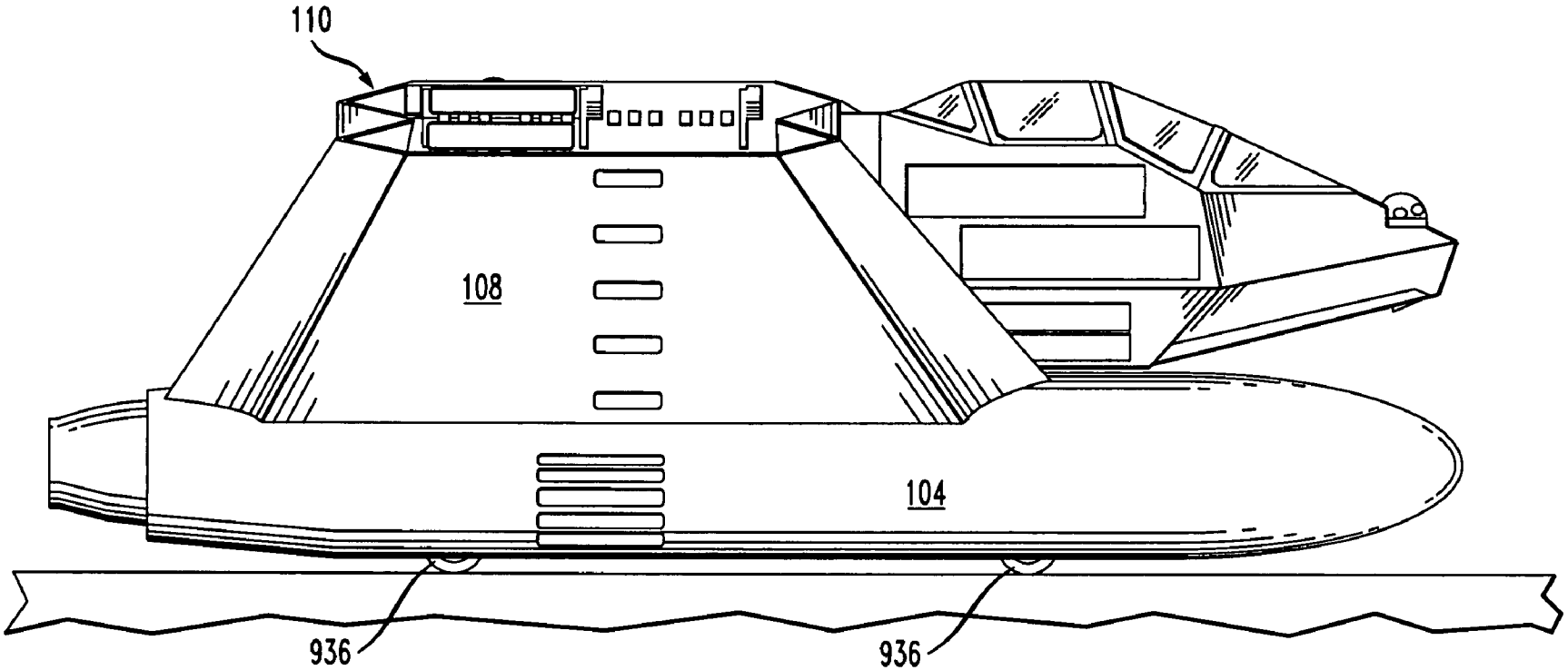
FIG. 10 depicts a side view of marine vessel 100 in the launch-and-recovery configuration.

FIGS. 1C, 9, and 10 depict marine vessel 100 in a launch-and-recovery configuration. In this configuration, lower strut 108 and upper strut 110 are folded so that they are substantially parallel to one another. In the launch-and-recovery configuration, marine vessel 100 occupies its minimum storage volume. In this configuration, the manned version of marine vessel 100 has a width of about 3.7 meters and a height of about 3.7 meters.

Description of the Basic Structural Elements of Marine Vessel 100

For pedagogical purposes, this Specification proceeds with the description of basic structural elements of marine vessel 100 (e.g., upper hull 102, struts 106, lower hulls 104, etc.). Afterwards, this Specification continues with further description of the salient attributes of the primary configurations and operational modes of marine vessel 100.

Figure 2:
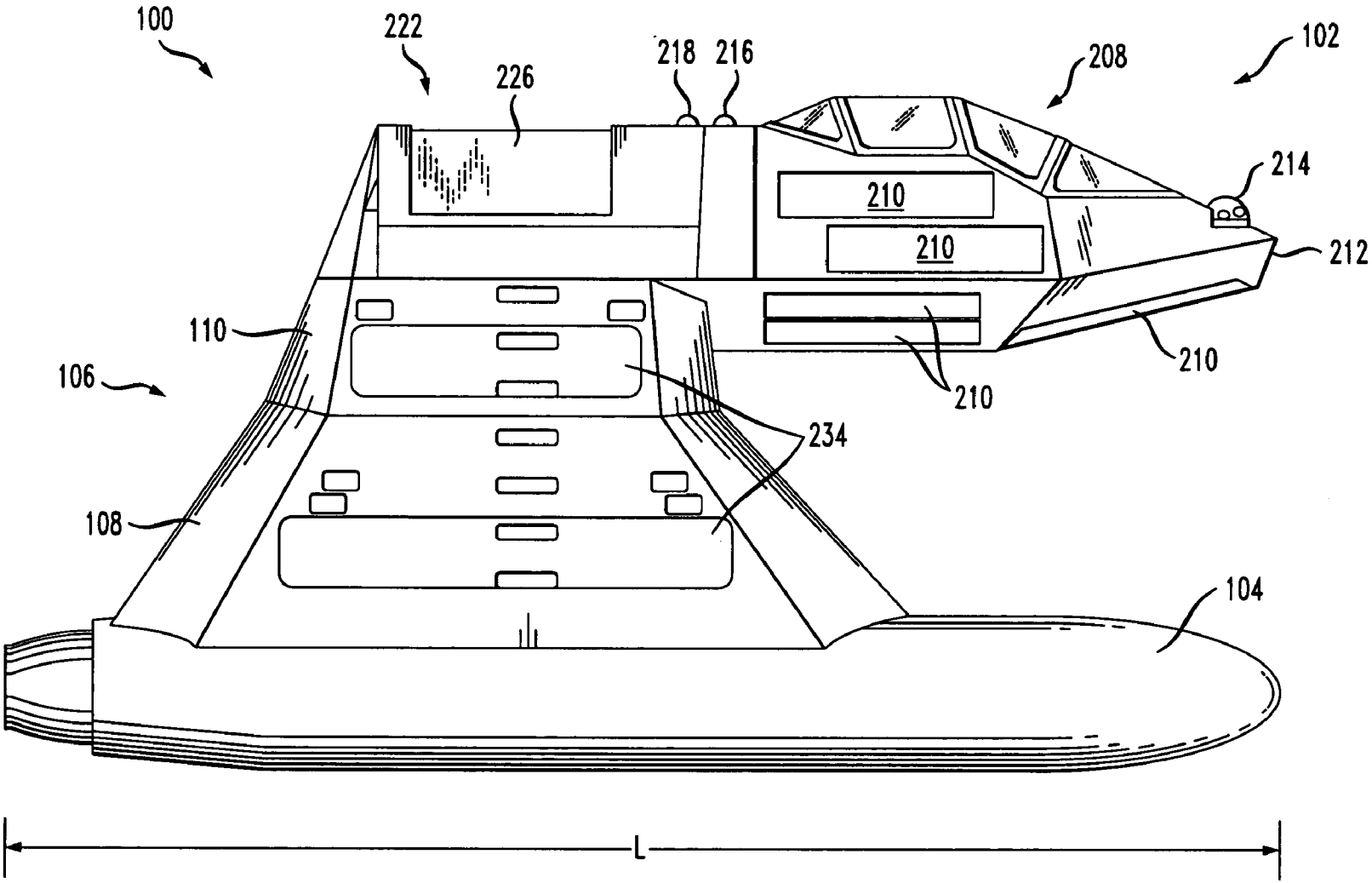
FIG. 2 depicts a side-view of marine vessel 100 in the cruise-and-surveillance configuration.
Figure 3:
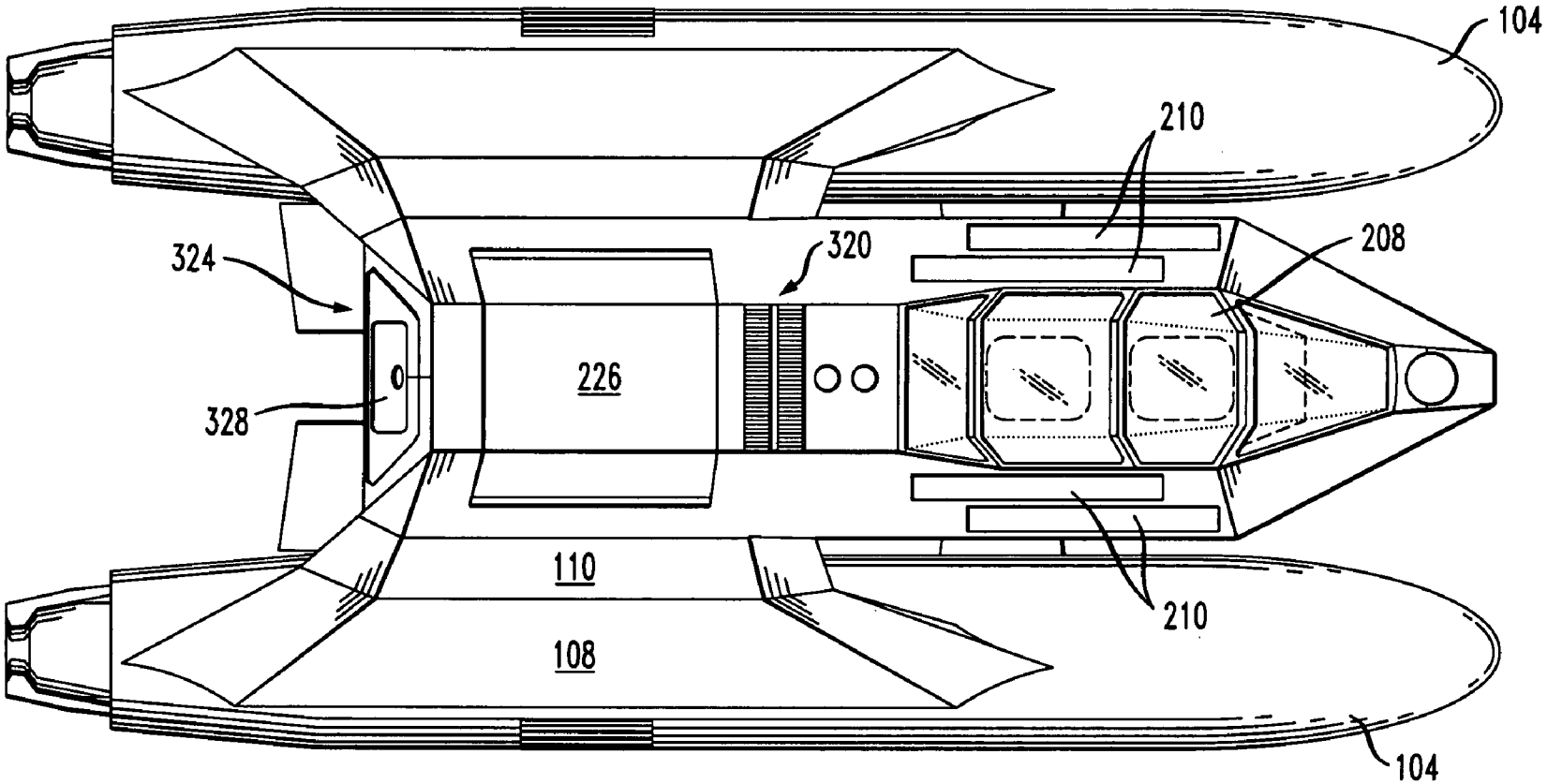
FIG. 3 depicts a top view of marine vessel 100 in the cruise-and-surveillance configuration.
Figure 4B:
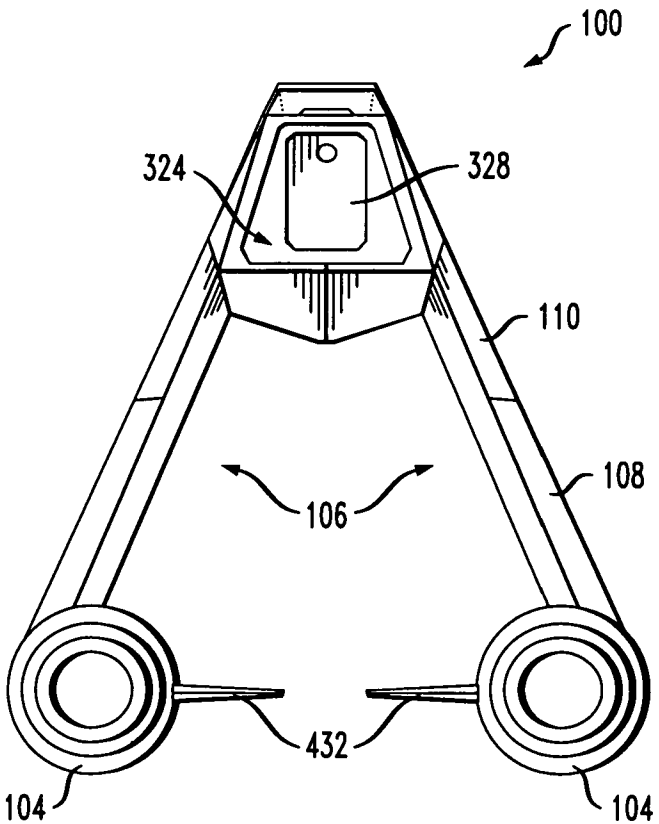
FIG. 4B depicts a stern-end view of marine vessel 100 in the cruise-and-surveillance configuration.
Figure 4A:
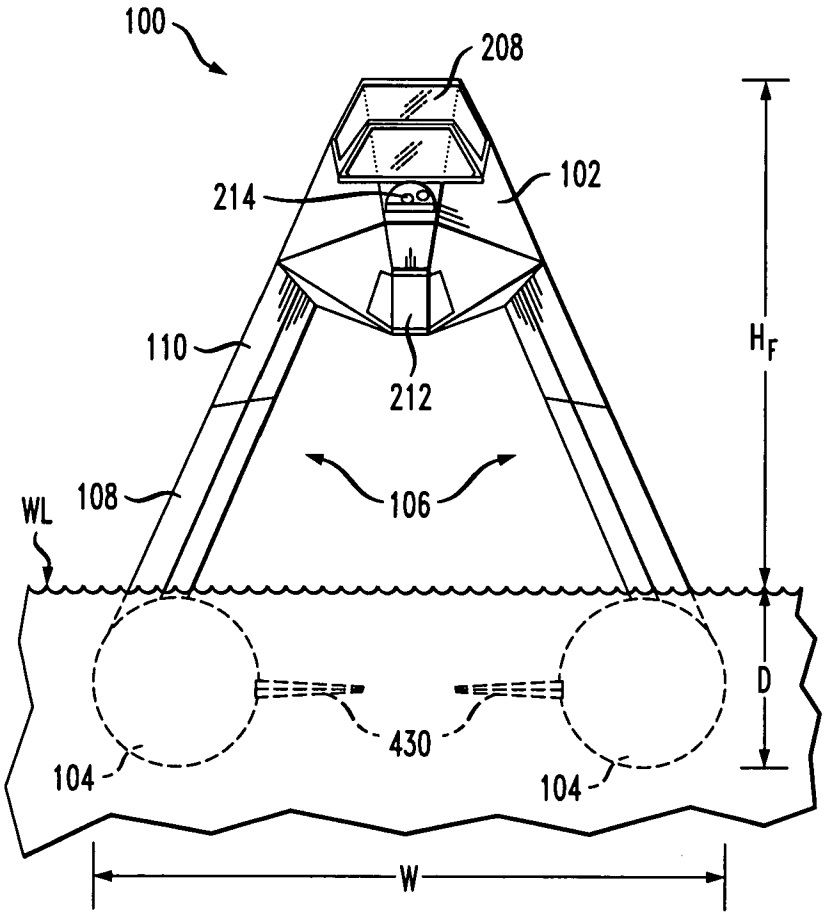
FIG. 4A depicts a bow-end view of marine vessel 100 in the cruise-and-surveillance configuration.

FIGS. 2, 3 and 4A-4B, which depict marine vessel 100 in the cruise-and-surveillance configuration, will be referenced for the description of the basic structural elements. FIG. 2 depicts a side view, FIG. 3 depicts a top view, FIG. 4A depicts a bow-end view, and FIG. 4B depicts a stern-end view of marine vessel 100.

Upper Hull 102

Referring now to FIGS. 2 through 4B, upper hull 102 includes cockpit 208, which typically accommodates a crew of 1 to 3 persons. Upper hull 102 also houses above-water sensors, most of the weapons and weapons control systems, the vehicle control systems, RF communications, and most of the countermeasures.

The core weapons supported by upper hull 102 are essentially those of an attack helicopter. Weapons include, without limitation, forward-firing, line-of-sight missiles, such as Hellfire, small caliber (e.g., 20 millimeter, etc.) machine guns/cannons, 40 millimeter automatic grenade launchers, short-range air-to-air missiles, and, in some embodiments, non line-of-sight missiles.

The core weapons that are carried by upper hull 102 are advantageously stowed internally in fully-retractable weapons bays 210 that rotate open for firing. The retractable bays reduce both drag and radar signature and are similar to those used in advanced attack helicopters.

The core sensors supported by upper hull 102 include navigation and avoidance radar 212, IR/EO search & targeting sensor 214, deployable RF communications antennae 216, and deployable sensors 218. The deployable antennae 216 and sensors 218 are disposed on two retractable/extendable masts that reside within upper hull 102. The masts, which retract to a length of about 1.2 meters, are capable of raising antennae 216 and sensors 218 to a height of about 3.7 meters above upper hull 102.

Snorkels 320 (FIG. 3) are disposed aft of cockpit 208. As described later in this Specification, snorkels 320 draw in air. The air is routed through ducting, as necessary, to the engines. In the illustrative embodiment, the engines are disposed in each lower hull 104.

Marine vessel 100 supports two types of mission systems: core systems and mission-specific payloads. Core systems are those that are carried on most missions and include, without limitation, the types of systems described above (e.g., navigation, communications, standard weapons and sensors, etc.).

As the name implies, mission-specific payloads are not normally carried on marine vessel 100 and are used, rather, in the context of specific missions. Examples of mission-specific payloads include, without limitation, certain types of weapons, specialized sensors, expendables, and even personnel.

In the illustrative embodiment, mission-specific payloads are carried in removable mission module 226. The mission module resides in mission-module bay 222, which is disposed toward the aft end of marine vessel 100. Mission module 224 is inserted into and removed from upper hull 102 through opening 324 at the stern of marine vessel 100 (see, e.g., FIG. 4B). Insertion and removal of mission module 226 can be performed, for example, while marine vessel 100 is aboard a mother ship. This accommodates changing missions without the need to outfit multiple vessels with a different complement of equipment.

Once inserted into marine vessel 100, the back of mission module 226 seals opening 324. Hatch 328 provides access to the interior of mission module 226. Additionally, in some embodiments, various hatches or ports (not depicted) are disposed on the top and sides of mission module 226. These hatches and ports are used for any of variety of purposes, including, for example, the deployment of mission-specific sensors, weapons, or expendables (e.g., sonobuoys, countermeasures, etc.).

In the illustrative embodiment, when mission module 226 is disposed in mission bay 224, the exterior of the mission module forms a portion of upper hull 102. Mission module 226 is configured with standard mechanical, electrical, and data interfaces that couple to appropriate interfaces within upper hull 102. In some embodiments, marine vessel 100 can operate with or without mission module 226. Further detail concerning mission module 226 is provided in U.S. patent application Ser. No. 11/118,262, as previously referenced.

Struts 106

Struts 106 depend from upper hull 102 and couple it to lower hulls 104. In the illustrative embodiment, each strut 106 is structurally segregated into lower segment 108 and upper segment 110. These two segments are movably coupled to one another and the upper segment is movably coupled to upper hull 102. As previously disclosed, it is these segmented, movable struts that enables marine vessel 100 to reconfigure.

Figure 5A:
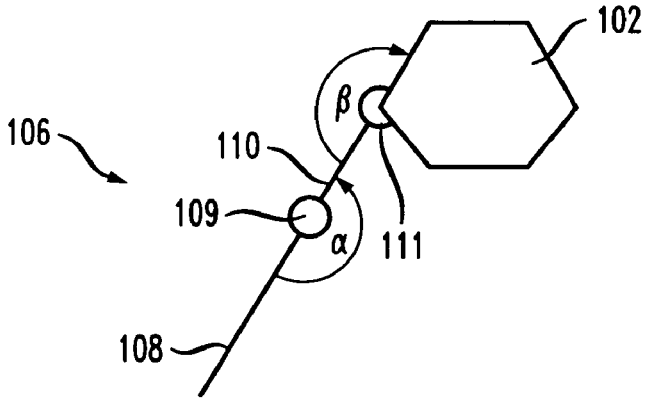
FIGS. 5A through 5C depict a representation of one of segmented struts 106 in each of the primary configurations: cruise-and-surveillance (FIG. 5A minimum-draft (FIG. 5B); and launch-and-recovery (FIG. 5C).
Figure 5B:
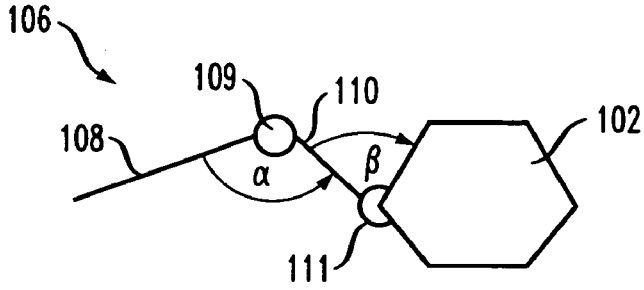
Figure 5C:
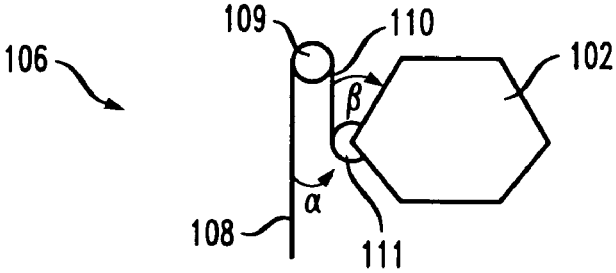

FIGS. 5A through 5C depict a simplified representation of one of segmented struts 106 in each of the primary configurations as an aid to description of the operation of the struts. In particular, FIG. 5A depicts the cruise-and-surveillance configuration, FIG. 5B depicts the minimum-draft configuration, and FIG. 5C depicts the launch-and-recovery configuration.

Using FIG. 5A as a reference or zero position, the arrows depict the direction of movement for each of the segments as marine vessel 100 reconfigures. In particular, lower segment 108 pivots around hinge 109 toward upper segment 110 in a counterclockwise direction. Upper segment 110 pivots around hinge 111 toward upper hull 102 in a clockwise direction. Angle $\alpha$ is defined as the angle between segment 108 and segment 110 and angle $\beta$ is defined as the angle between segment 110 and the side of upper hull 102. It is to be understood that the direction of movement indicated for lower segment 108 and upper segment 110 is relative to the reference position that is depicted in FIG. 5A. That is, lower segment 108 is capable of moving in a clockwise direction and upper segment 110 is capable of moving in a counterclockwise direction. The direction of movement is simply a function of the starting and ending configurations.

Referring now to FIG. 5A—the cruise-and-surveillance configuration—segments 108 and 110 are co-linear. That is, angle $\alpha$ between segment 108 and segment 110 is 180 degrees. Furthermore, angle $\beta$ between segment 110 and the side of upper hull 102 is advantageously 180 degrees. Orienting segment 110 at 180 degrees relative to upper hull 102 results in a smooth, continuous surface, which reduces the signature (radar, etc.) of marine vessel 100.

FIG. 5B depicts strut 106 in the minimum-draft configuration. In this configuration, angle $\alpha$ is about 120 degrees and angle $\beta$ is about 55 degrees. As a consequence, to reconfigure from the nominal cruise-and-surveillance configuration to the nominal minimum-draft configuration, segment 110 pivots clockwise toward upper hull 102 through about 125 degrees. Segment 108 pivots counterclockwise toward segment 110 through about 60 degrees.

FIG. 5C depicts strut 106 in the launch-and-recovery configuration. In this configuration, angle $\alpha$ is about 0 degrees and angle $\beta$ is about 15 degrees. As a consequence, to reconfigure from the nominal cruise-and-surveillance configuration to the nominal launch-and-recovery configuration, segment 110 moves clockwise toward upper hull 102 through about 165 degrees and segment 108 moves counterclockwise toward segment 110 through about 180 degrees.

It is to be understood that in other embodiments, angles $\alpha$ and $\beta$ can have other values. Also, to the extent that marine vessel 100 is placed in intermediate configurations, these angles will have other values. Furthermore, the range of movement of segments 108 and 110 might be limited or expanded by any number of factors, including the choice of hinge mechanism, physical attributes of segments 108 and/or 110, etc. Those skilled in the art, after reading this disclosure, will be able to select suitable values for angles $\alpha$ and $\beta$ for a particular configuration and define a suitable overall range of motion for strut segments 108 and 110.

In the illustrative embodiment, the mechanisms that are required for repositioning the upper and lower sections of the strut are housed primarily within upper strut segment 110. In some alternative embodiments, at least some of the mechanisms (e.g., motors, linear actuators, etc.) are disposed elsewhere in marine vessel 100 (e.g., in upper hull 102, etc.).

Any of a variety of different mechanisms can be used for repositioning segments 108 and 110 of strut 106. For example, in some embodiments, a power hinge, such as are used at the wing-folds of carrier aircraft can be used. The power hinge is essentially a tubular planetary-gear assembly that generates very high mechanical advantage and is driven by either a closed circuit (no voluminous reservoir) hydraulic motor or an electric motor. The power hinge is commercially available from Moog, of East Aurora, N.Y., or others.

In some other embodiments, a mechanism comprising relatively long hinges that are powered by linear hydraulic actuators can be used. Those skilled in the art, after reading this disclosure, will be able to design and build mechanisms that are suitable for repositioning segments 108 and 110 of strut 106.

In addition to the presence of strut-repositioning mechanisms, both lower 108 and upper 110 segments of strut 106 house conduits for electrical power and data cabling, as well as air ducts for channeling intake air from snorkels 320 in upper hull 102 to engines (e.g., diesel engines, etc.) in lower hulls 104. Furthermore, while some of the internal volume of lower segment 108 of strut 106 is free flooding, other portions of the internal volume accommodates air/water ballast tanks (not depicted). These tanks are flooded or deflooded ("blown") with compressed air to maintain vessel 100 in a desired state of buoyancy.

Lower Hulls 104

Unmanned lower hulls 104 provide most of the buoyancy that enables marine vessel 100 to float, for all configurations. The lower hulls also support forward 430 and aft 432 control planes. These control planes control the attitude, depth and stability of marine vessel 100 while it's underway. In some embodiments, marine vessel 100 incorporates a two-degree of freedom rudder/stabilizer instead of one set or both sets of control planes 430 and 432. The two-degree of freedom rudder/stabilizer is described in U.S. Pat. No. 6,880,478 B2, and incorporated by reference herein.

In the illustrative embodiment, lower hulls 104 houses most of the buoyancy controls of marine vessel 100 and houses the propulsion system(s). In the illustrative embodiment, each lower hull 104 contains a diesel engine that drives a water jet to propel marine vessel 100. As previously disclosed, air is conducted from snorkels 320 (on top of upper hull 102) through ducting in struts 106, to the engines.

In some embodiments, the water jet can be electrically driven at slow speeds. In such embodiments, electrical power is stored in batteries that are charged by the diesel engines when they are running. Electricity can also be generated by a reformer/fuel-cell system that generates electricity directly from the diesel-fuel stores of marine vessel 100.

In some further embodiments, each lower hull 102 contains an electrically driven, retractable propulsor (in addition to the diesel engines). The propulsor is used to propel the vessel at very slow speeds for quiet missions, docking and launch maneuvering.

As previously indicated, the height and width of marine vessel 100 is variable as a function of its configuration. Its length L is, however, substantially invariant and is dictated by the size of lower hulls 104 (see, e.g., FIG. 2). Length L of marine vessel 100 is within a range of about 11 to 12.2 meters and the length of the unmanned version is about half—6.7 meters—of the length of vessel 100. It will be appreciated that a vessel in accordance with the illustrative embodiment can be built to have a different size than vessel 100, but for the functionality described herein, the stated sizes are expected to be suitable and desirable.

Ancillary Structural Considerations

The hull form of marine vessel 100 is adapted to reduce its visual, infrared, and radar signatures, which are quite low compared to those of most surface combatants. Submerged lower hulls 104 vent exhaust below the surface of the water and low reflectivity surface designs (e.g., stealth design, etc.) on both upper hull 102 and struts 106 reduce emissions and reflectivity at most detection frequencies. The hulls, struts, and most of the equipment housed in vessel 100 will be formed of non-magnetic materials to reduce the vessel's magnetic signature. Furthermore, the hull lines are advantageously optimized to reduce acoustic noise in known fashion.

As marine vessel 100 approaches another vessel for inspection or boarding, or is deploying a force, it is desirable for crew members to be outside of the vessel, in position to board or otherwise disembark. To that end, utility platforms 234 are included on struts 106. The platforms fold flush with the surface of the struts when not in use and rotate away from the surface of the struts for use.

Marine vessel 100 also has wheels 936, which are housed in lower hulls 106. The wheels are deployed when marine vessel 100 is in its launch-and-recovery configuration.

For the purposes of this Description and the appended claims, the term "propulsion hull" means a hull, pontoon, etc., that contains a propulsion device. As a consequence, lower hulls 104 are propulsion hulls. For marine vessel 100, lower hulls 104 are always at least partially submerged when the vessel is in the water. It is to be understood, however, that the term "propulsion hull" is more general and can, in some embodiments, refer to a hull that contains a propulsion device and that operates completely above the water line.

Operation

Having described the salient structural elements of marine vessel 100, further description of the various operational configurations and modes is now presented.

Referring again to FIGS. 2, 3, and 4A-4B, and also to FIGS. 6A through 6C, various operating modes of the cruise-and-surveillance configuration are now described.

The various modes of the cruise-and-surveillance configuration are obtained by changing the draft of marine vessel 100, as follows. During normal operations, autopilot or pilot control inputs are translated into movements of control planes 430 and 432 that raise and lower vessel 100. Buoyancy tanks are automatically flooded or vented to maintain a neutrally-buoyant condition.

During normal high and moderate speed operations, the lower limit of control is the point at which upper hull 102 is just entering the water and the upper limit is the point at which the upper portion of lower hulls 104 are just out of the water. As a consequence, during forward movement, the height of vessel 100 can be quickly changed with little change in speed, so that it can quickly transition from one mode to another.

FIG. 6A depicts marine vessel 100 in a relatively slow-speed mode of the cruise-and-surveillance configuration. In this mode, marine vessel is floating with about 10 to 15 percent of the volume of lower hulls breaching the water line WL. In this mode, the marine vessel's sea keeping is adequate only in relatively less-stressing sea states (i.e., sea state 1 or 2). This mode is typically used for traversing relatively calm waters, approaching piers and sheltered mooring facilities. The draft for this mode is about 1.4 meters, which is the minimum draft for the cruise-and-surveillance configuration. For marine vessel 100, clearance C between water line WL and the bottom of upper hull 102 is about 2.1 meters in this mode.

FIG. 6B depicts marine vessel 100 in SWATH mode. Lower hulls 104 are completely submerged but upper hull 102 is above water line WL. In this mode, marine vessel 100 provides stable, high-speed operation when operating in relatively higher sea states. The submerged lower hulls provide vessel buoyancy that does not change appreciably when subjected to moderate wave action on the surface. As the sea state increases, stability is maintained by further submerging the lower hulls (using the ballasting system) together with control plane reactions. This mode of operation is used in both calm and high sea states to provide speed in both tactically offensive and defensive situations. The maximum draft for this mode (for marine vessel 100 having the nominal size previously indicated) is about 3.5 meters.

FIG. 6C depicts marine vessel 100 in a loitering and reconnaissance mode. In this mode, lower hulls 104 and struts 106 are completely submerged, and about 30 to 40 percent of the volume of upper hull 102 is below the water line. Marine vessel 100 is stable in high sea states in this mode (but not at speed). Draft for marine vessel 100 approaches about 4.9 meters (for the manned version).

This mode of operation is used primarily for intelligence gathering, surveillance, and reconnaissance missions that would require the ability to loiter in contested littoral environments in which mission success is dependent on being able to remain undetected for an extended period of time.

As implied above, marine vessel 100 has the ability to partially submerge—and to do so at speed—when necessary. This capability is a fundamental survival technique on any battlefield, including littorals. Soldier "duck," tanks and artillery "defilade," and both attack helicopters and strike aircraft fly "nape of the earth" all to avoid detection and engage the enemy on their own terms. But very few naval vessels, with the exception of submarines of course, have this capability. Those few special ships that have an ability to partially submerge or "duck" (mostly SOF vessels) must typically do so at very slow speeds.

The ability of marine vessel 100 to change depth enables it to change the height of its sensor at the top of upper hull 102. In the illustrative embodiment, the extendable mast raises the sensors about 3.7 meters above upper hull 104. When marine vessel 100 is in the loitering and reconnaissance mode (FIG. 6C), the sensors are raised to about 4.6 meters above the waterline. When, marine vessel 100 is in its slow-speed mode (FIG. 6A), the sensors are about 7.6 meters above the surface of the water, which facilitates over-the-horizon sensing.

Thus, during patrol, marine vessel 100 can operate in slow-speed mode with its sensor at maximum height until sensors detect another surface craft of interest. Once the other craft is detected and its position is fixed, marine vessel 100 descends and proceeds toward the other craft undetected because of the masking provided by the visual and radar horizons. When vessel 100 is within optimum engagement range of its own weapons, it can rapidly ascend to elevate upper hull 102 to engage the other craft, as appropriate.

FIGS. 7 and 8 depict marine vessel 100 in the minimum-draft configuration. As previously described, in this configuration, struts 106 are extended laterally relative to upper-hull 102 such that the bottom of the upper hull is substantially co-planar with the bottom of lower hulls 104.

In this configuration, marine vessel 100 exhibits, as the name implies, its minimum draft $D_m$, which for the illustrative embodiment is about 0.9 meters. Also, in this configuration, marine vessel 100 has its maximum width W, which for the illustrative embodiment is about 9.5 meters. The highest part of upper hull 102—cockpit 208—is about 1.2 meters about water line WL, as depicted in FIG. 8 (i.e., $H_F$=1.2 meters).

The minimum-draft configuration is a relatively slow-speed mode in which marine vessel 100 is stable only in relatively less-stressing sea states. This mode would typically be used for traversing the surf zone and approaching the beach for the insertion or extraction of personnel or cargo.

FIGS. 9 and 10 depict marine vessel 100 in the launch-and-recovery configuration. In this configuration, lower segment 108 and upper segment 110 of struts 106 fold flat against one another in a substantially vertical orientation. This reduces the overall width W of vessel 100 to about 3.7 meters or less in the illustrative embodiment. As depicted in FIG. 9, the control planes are folded when marine vessel 100 is in this configuration (only front control planes 430 are depicted in FIG. 9).

When marine vessel 100 is in its launch-and-recovery configuration, wheels 936, which are housed in lower hulls 104, are deployed. This facilitates moving marine vessel 100 about the operation decks of its mother ship without additional handling equipment (e.g. cranes, etc.).

Figure 11:
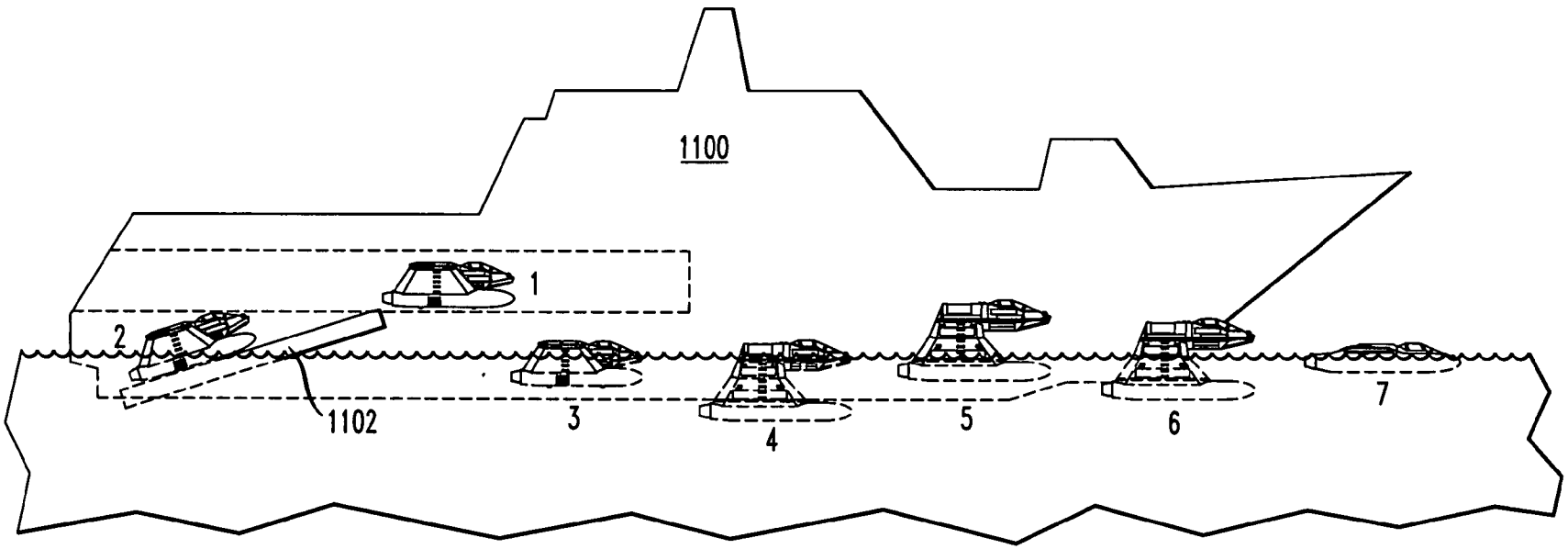
FIG. 11 depicts a side view of a mother ship and marine vessel 100, wherein marine vessel 100 is shown in its three primary configurations and three primary modes.

FIG. 11 depicts marine vessel 100 in all three of its primary configurations and operating modes near mother ship 1100.

The launch-and-recovery configuration, which is used for transportation, launch and recovery, is depicted at points 1, 2, and 3. Point 1 depicts marine vessel 100 in mother ship 1100, point 2 depicts marine vessel 100 ascending or descending ramp 1102, and point 3 depicts the marine vessel preparing to reconfigure for operation.

The cruise-and-surveillance mode is depicted at points 4 through 6. At point 4, marine vessel 100 has reconfigured and is substantially submerged for surveillance. Point 5 depicts marine vessel 100 patrolling in its slow-speed mode, and point 6 depicts the marine vessel at an intermediate height for high-speed cruising.

The minimum-draft configuration is depicted at point 7. Marine vessel 100 has reconfigured to this configuration while underway, in preparation for entering very shallow water.

It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Furthermore, it is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

I claim:

1. A reconfigurable marine vessel having a small waterplane area twin hull form, the marine vessel comprising:

an upper hull having internally-stowable and deployable weapons and sensors and a removable mission module that forms a portion of the upper hull;

two lower hulls that are capable of providing substantially all of the buoyancy required for the marine vessel, wherein the marine vessel does not utilize dynamic lift;

two articulated struts for coupling the lower hulls to the upper hull, wherein the articulated struts comprise at least two segments that are operable to move out-of-plane relative to one another and that enable reconfiguration of the marine vessel between three primary configurations, wherein the primary configurations include:

(a) a cruise and surveillance configuration, wherein the articulated struts are extended downward and outward from the upper hull;

(b) a minimum draft configuration, wherein the articulated struts are laterally extended relative to the upper hull; and (c) a launch/recovery configuration, wherein the articulated struts are folded such that the two segments of the struts are substantially parallel to one another;

a ballasting system for providing a desired amount of buoyancy to the marine vessel, wherein the ballasting system is operable to enable the marine vessel to change its draft while in the cruise and surveillance configuration between a minimum draft mode wherein a portion of the two lower hulls are not submerged and a maximum draft mode wherein a portion of the upper hull is submerged; and a propulsion system, wherein the propulsion system is contained in the two lower hulls.

2. The marine vessel of claim 1 wherein the upper hull comprises a first removable mission module that forms a portion of the upper hull, wherein the first mission module contains first mission-specific equipment, and wherein the first mission module is replaceable by a second removable mission module that forms a portion of the upper hull, wherein the second mission module contains second mission-specific equipment, at least some of which is different from the first mission-specific equipment.

3. The marine vessel of claim 1 wherein when the marine vessel is in the first configuration, the ballasting system is operable to ballast the marine vessel so that the marine vessel operates as a SWATH craft, wherein the two propulsion hulls are submerged and the upper hull is above the water line.

4. The marine vessel of claim 2 wherein when the marine vessel is in the first configuration, the ballasting system is operable to ballast the marine vessel so that the marine vessel does not operate as a SWATH craft, wherein either:

(a) a portion of each of the propulsion hulls is above the water line; or (b) a portion of the upper hull is below the water line.

5. A reconfigurable marine vessel having a small waterplane area twin hull form, the marine vessel comprising:

an upper hull having internally-stowable and deployable weapons and sensors;

two propulsion hulls that do not generate dynamic lift; and two articulated struts, wherein the struts couple the two propulsion hulls the upper hull to one another, and wherein the articulated struts are operable to change a spatial relationship of the two propulsion hulls to the upper hull, thereby providing a capability for multiple configurations of the marine vessel, wherein:

(a) in a first configuration, the two struts extend downward and outward of the upper hull;

(b) in a second configuration, the two struts extend substantially laterally relative to the upper hull; and (c) in a third configuration, the articulated struts are folded at a joint, wherein two portions of each the articulated struts are substantially parallel to one another;

a ballasting system operable to change a draft of the marine vessel, wherein when the marine vessel is in the first configuration, the ballasting system is operable to ballast the marine vessel between a first position wherein all of the upper hull is above a water line and a second position wherein some portion of the upper hull is below the water line.

6. A reconfigurable marine vessel having a small waterplane area twin hull form, the marine vessel comprising:

an upper hull having internally-stowable and deployable weapons and sensors;

two propulsion hulls; and two articulated struts that couple the two propulsion hulls and the upper hull to each other, wherein the articulated struts are operable to change a spatial relationship of the two propulsion hulls to the upper hull, thereby providing a capability for multiple configurations of the marine vessel, wherein:

(a) in a SWATH configuration, the two struts extend downward and outward of the upper hull;

(b) in a second configuration, the two struts extend substantially laterally relative to the upper hull; and (c) in a third configuration, the articulated struts are folded at a joint, wherein two portions of each the articulated struts are substantially parallel to one another;

a ballasting system operable to change a draft of the marine vessel, wherein, in conjunction with the multiple configurations of the marine vessel, the ballasting system provides a capability for multiple operating modes of the marine vessel, including:

a SWATH operating mode wherein the marine vessel has the SWATH configuration and wherein the two propulsion hulls are submerged and the upper hull is above a water line;

a first non-SWATH operating mode wherein the marine vessel has the SWATH configuration and the two propulsion hulls are not fully submerged;

a second non-SWATH operating mode wherein the marine vessel has the SWATH configuration and the upper hull is partially submerged;

a third non-SWATH operating mode wherein the marine vessel has the second configuration and the two propulsion hulls and the upper hull are partially submerged; and a fourth non-SWATH operating mode wherein the marine vessel has the third configuration and the two propulsion hulls and the upper hull are partially submerged.

* * * * *